United States Patent [19]

Evans

[11] Patent Number: 4,743,911

[45] Date of Patent: May 10, 1988

[54] CONSTANT BEAMWIDTH ANTENNA

[75] Inventor: Gary E. Evans, Trappe, Md.

[73] Assignee: Westinghouse Electric Corp., Pittsburgh, Pa.

[21] Appl. No.: 835,675

[22] Filed: Mar. 3, 1986

[51] Int. Cl.[4] ..... H01Q 19/06

[52] U.S. Cl. ..... 342/375

[58] Field of Search ..... 342/368, 371, 373, 375; 333/110; 343/754

[56] References Cited

U.S. PATENT DOCUMENTS

| | | | |
|---|---|---|---|
| Re. 26,680 | 10/1969 | Rosen | 342/354 |
| 3,153,788 | 10/1964 | Washburne | 342/368 |
| 3,517,389 | 6/1970 | Dausin | 342/371 |
| 3,518,689 | 6/1970 | Algeo et al. | 343/778 |
| 3,680,109 | 7/1972 | Steudel | 342/371 |
| 3,766,558 | 10/1973 | Kuechken | 342/375 |
| 3,911,442 | 10/1975 | Hatch | 342/371 X |
| 3,964,069 | 6/1976 | McDonough | 342/371 X |

*Primary Examiner*—Theodore M. Blum

*Assistant Examiner*—Bernarr Earl Gregory

*Attorney, Agent, or Firm*—W. G. Sutcliff

[57] ABSTRACT

An array antenna feed system which provides a constant beamwidth over a large bandwidth of operating frequencies. In transmitter applications, the applied signal is divided into correction and basic signals by a frequency sensitive splitter. The magnitudes of the basic and correction signals provided by the splitter vary sinusoidally with frequency and are displaced a quarter cycle from each other on the frequency scale. The correction and basic signals are combined in series or corporate coupler arrays to drive the individual antenna elements. Coupler coefficients are predetermined to make the complex addition of the correction and basic signals provide a resulting synthesized signal which gives the desired voltage distribution for the same beamwidth at the operating frequency limits. In receiving applications, the splitter functions to combine the correction and basic signals from the coupler array and transfer a combined signal to the receiver circuitry.

15 Claims, 3 Drawing Sheets

CONSTANT BEAMWIDTH ANTENNA

BACKGROUND OF THE INVENTION

This invention relates, in general, to radar antennas and, more specifically, to systems for shaping the beam of array antennas.

Array antenna systems are used in a wide variety of radar systems. Search radar systems, in particular, use array antenna systems which have a narrow beamwidth in the azimuth direction and a broad beamwidth in the elevation plane. Normally, the antenna is rotated mechanically in azimuth while the broad elevation beam sweeps the area for incoming signals. Beamwidths in the elevation plane are frequently between 20 and 60 degrees with such radar systems.

In order to improve the operation of the search radar system, it is desirable to change the frequency of operation of the radar system while the antenna is scanning. A bandwidth of 10% of the operating frequency is a typical requirement with such systems. However, changing the frequency presents problems in maintaining the desired beamwidth of the antenna. It is well known that a fixed set of signals having a particular phase and amplitude must be applied to the antenna elements in order to produce a desired pattern. Traditionally, it has been conventional practice to construct the microwave power dividers which feed the individual antenna elements in such a manner that they perform their function independently of the frequency of operation of the antenna. Unfortunately, even with maintaining the same phase and amplitude at the antenna elements, the beamwidth or beam pattern of the antenna changes with frequency simply because the physical size of the antenna and the distance between the antenna elements is a different number of wave lengths at each of the operating frequency.

It is also standard practice to construct such an antenna with components which provide the proper beamwidth at the highest frequency of operation to ensure full coverage. However, such design techniques cause the beamwidth to be larger and the overall gain to be lower when the antenna is operated at lower frequencies than the design frequency. Ideally, it is desirable, and it is an object of this invention, to provide an antenna system having a substantially constant beamwidth over a wide frequency range of operation, and to provide this capability with the least amount of apparatus.

SUMMARY OF THE INVENTION

There is disclosed herein a new and useful antenna system which exhibits a constant beamwidth pattern over a wide range of operating frequencies. A single frequency sensitive signal splitter is used for the entire antenna to divide the antanna signal into basic and corrective circuits, or paths. The basic signal provides the voltage distribution on the antenna elements which produces the desired pattern and beamwidth when the antenna is operating at the center frequency of its operating bandwidth. The corrective signal either adds to or subtracts from the basic signal as the frequency changes from the center value.

In one embodiment, the basic and correction signals are directed over a series circuit which includes, for each antenna element or group of elements, a directional coupler on a basic signal circuit and another directional coupler on a correction signal circuit. In another embodiment of the invention, the basic and correction signals are directed over a corporate circuit which includes an array of couplers for connecting the basic and correction signals to several pairs of antenna elements. In both embodiments, the basic and correction signals are suitably combined to give the desired voltage and phase distribution on the antenna elements for producting the desired beamwidth at the operating frequency.

The single frequency sensitive signal splitter, or correction coupler, provides the two separate signals needed by all of the antenna elements. The signal splitter includes two transmission paths coupled together by two directional couplers. The length of one path between the two directional couplers is extended by an odd number of one-half wave lengths of the center frequency of operation. The signal provided by the non-extended path, or the direct path through the couplers, is the basic signal and the signal provided by the extended, or coupled, path is the correction signal.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
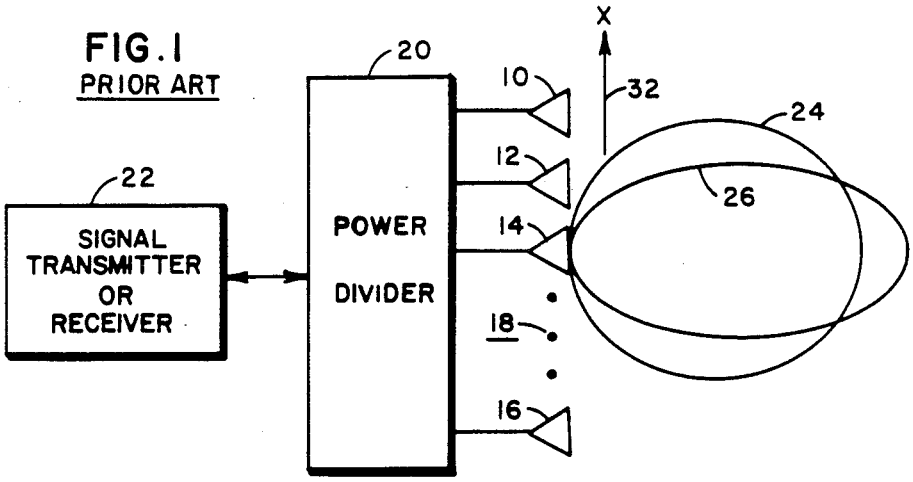
FIG. 1 PRIOR ART
FIG. 1 is a diagram illustrating the general construction of an array antenna and the beam patterns normally associated with different frequencies.

Throughout the following description, similar reference characters refer to similar elements or members in all of the figures of the drawings.

Referring now to the drawings, and to FIG. 1 in particular, there is shown an array antenna having different beamwidths at different frequencies. The antenna elements 10, 12, 14 and 16 are located at different vertical positions in the antenna system. The dots 18 indicate that additional antenna elements may be used with the antenna structure. Each antenna element is coupled to a signal transmitter or receiver 22. Since the antanna may be used for either transmitting or receiving signals, and since the invention will work with either type of antenna, the power divider 20 may be fed by a transmitter 22 or may be combining signals for application to a receiver. In either case, the teachings of this invention are applicable.

Beam patterns 24 and 26 indicate possible beam shapes originating from the array antenna when operating over different frequencies. Beam pattern 26 represents the beam pattern when the desired pattern is designed to be produced at the highest frequency of operation. Beam pattern 24 represents the pattern which would be produced when the antenna was operating at a lower frequency without the constant beamwidth circuit of this invention. Although the illustration may indicate that the antenna patterns are provided only by antenna element 14, it is the interacting of all the antenna elements of the array which produces the antenna patterns shown.

Figure 2:
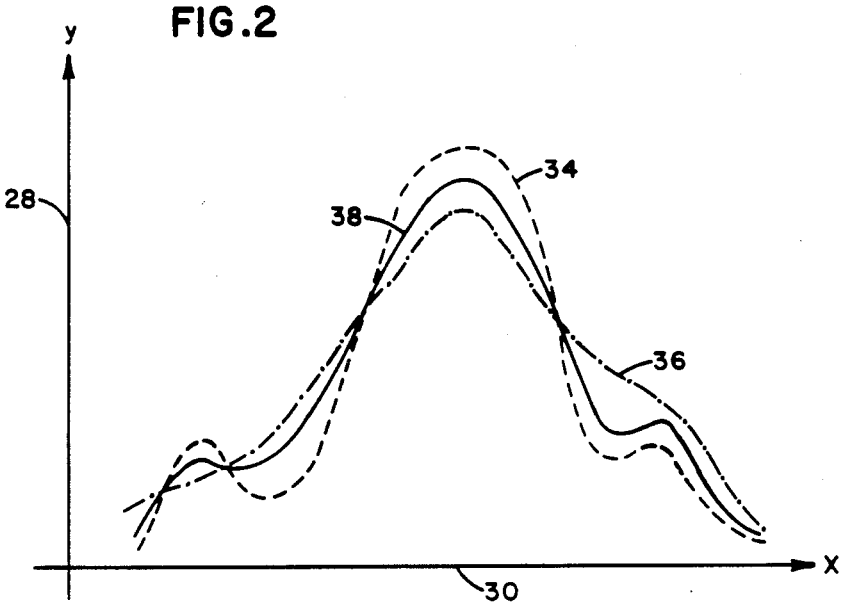
FIG. 2 is a graph illustrating the desired voltage distribution on the antenna elements for different frequencies.

FIG. 2 is a graph illustrating the desired complex voltage distributions for the separate antenna elements for a typical case. Axis 28 corresponds to the magnitude of the complex voltage on the antenna elements, and axis 30 corresponds to the vertical location of the antenna elements, or group of elements, which direction is indicated by arrow 32 in FIG. 1. Curve 34 of FIG. 2 illustrates the voltage distribution across the antenna elements which would be desired to produce a predetermined beamwidth at the high frequency limit of the operating bandwidth. Calculating the voltage distribution for such elements at a fixed frequency is a known practice in the prior art and, depending upon the physical relationships of the antenna elements, a curve having the fluctuations illustrated by curve 34 can be developed by those skilled in the art. Curve 36 of FIG. 2 represents the voltage distribution across the antenna elements for the lowest frequency of operation of the antenna system. This distribution, at the lowest frequency, is calculated to provide the same beamwidth and antenna pattern as is provided by the distribution of curve 34 at the highest frequency. Thus, the two curves, curves 34 and 36, represent the voltage distribution at the high and low frequency limits, respectively, of the antenna, which is necessary to provide the same beamwidth.

Curve 38 forms the basic distribution curve of the antanna system and is equal to the arithmetic average of the curves 34 and 36. Since, for proper operation of the antenna at the high frequency limit, the voltage distribution should be according to curve 34, and at the low frequency limit the distribution should be according to curve 36, the correction circuitry of this invention must provide these distribution levels at these frequency limits. In order to accomplish this result, the system of this invention provides a basic distribution according to curve 38 on the antenna elements and provides an incremental or correction distribution equal to the difference between curve 38 and either curve 34 or curve 36. Thus, the correction distribution is vectorially added to the curve 38 to produce curves between curves 34 and 36, depending upon the instantaneous frequency of operation of the antenna system.

Figure 3:
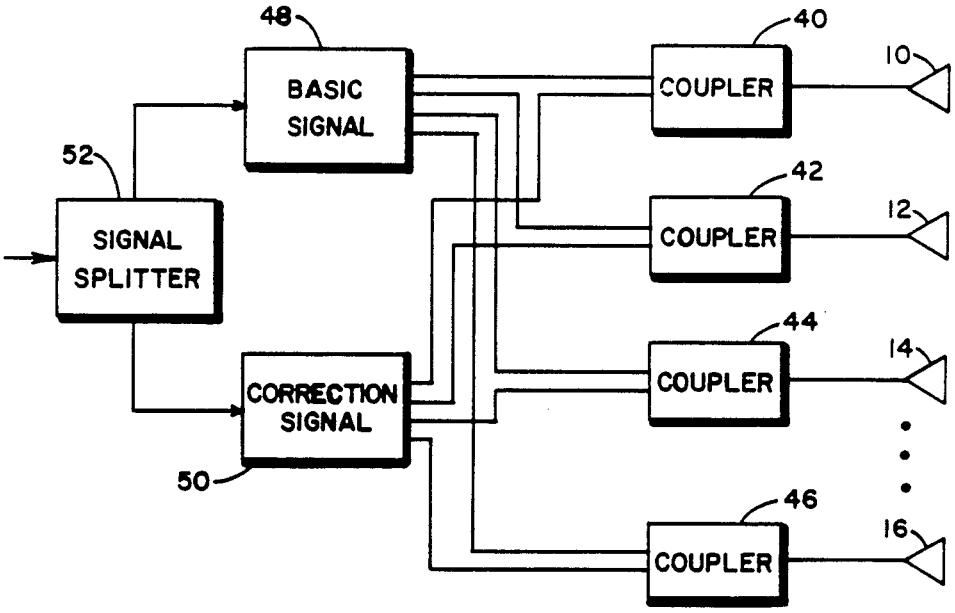
FIG. 3 is a diagram illustrating the fundamental distribution and interconnection system of the invention.

FIG. 3 is a diagram illustrating the fundamental distribution and interconnection of the power divider constructed according to this invention. It would not be used in this simplified form in practice since it would have unnecessary sharing loss, but it serves to illustrate the principles. The antenna elements 10, 12, 14 and 16 are each connected through directional couplers 40, 42, 44 and 46, respectively, to a basic signal divider circuit 48 and to a correction signal divider circuit 50. The basic signal divider circuit 48 is coupled to a signal splitter 52 which also is coupled to the correction signal divider circuit 50. The signal splitter 52, which will be described in more detail later, splits the incoming signal, in transmitter applications, into a basic signal and a correction signal. In receiving applications, the signal splitter 52 would combine basic and correction signals into a common signal and, effectively, operate in the opposite direction. The basic signal 48 furnishes the basic signal illustrated by curve 38 of FIG. 2 to the respective antenna elements. The correction signal 50 furnishes the signal which is necessary at the particular operating frequency to change the distribution to the desired distribution which gives the same antenna beamwidth. The basic and correction signals are combined in the respective couplers and applied to the separate antenna elements, as shown in FIG. 3.

Figure 4:
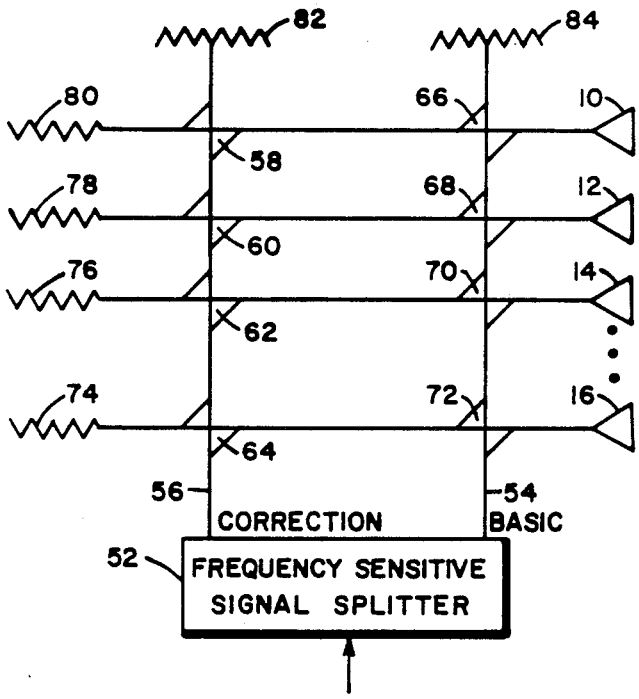
FIG. 4 is a diagram illustrating a series embodiment of the invention.

FIG. 4 is a diagram illustrating a series embodiment of the invention. The frequency sensitive signal splitter 52 divides the incoming signal from the radar transmitter into correction and basic components. The basic component is applied to waveguide 54 which provides a circuit, or path, for connecting the basic signal to the antenna elements, or radiators, 10, 12, 14 and 16. The correction signals are applied to waveguide or path 56 which, ultimately, directs the correction signal to the antenna elements. Before reaching the antenna elements, the correction and basic signals are applied to directional couplers which are represented, in conventional schematic form, in FIG. 4. Directional couplers 58, 60, 62 and 64 couple the correction signal to the waveguides leading to the directional couplers 66, 68, 70 and 72 which couple the basic signal to the correction signals and to the radiating elements. The loads 74, 76, 78, 80, 82 and 84 are used to terminate unused connections to the directional couplers as is conventional practice in the prior art.

The directional couplers shown in FIG. 4 have coupling coefficients or values which determine the amount of coupling between the signal paths to which they are connected. The coupling values of the directional couples 66, 68, 70 and 72 are selected to give the basic distribution according to curve 38 of FIG. 2. Couplers 58, 60, 62 and 64 have coupling values which are suitable to couple the amount of correction signal to the basic signal to provide the high and low frequency distribution curves of FIG. 2, depending, of course, upon the magnitude of the correction voltage. Selection of the coupler values for the directional couplers in the basic circuit, or path, to provide a known distribution can be done be conventional means as is well known in the prior art. Selection of coupler values for the directional couplers in the correction circuit 56 can also be done by conventional means, but is designed to provide the degree of coupling necessary for modifying the basic signal by an appropriate amount to produce the high and low frequency voltage distributions at the band edges.

Figure 5:
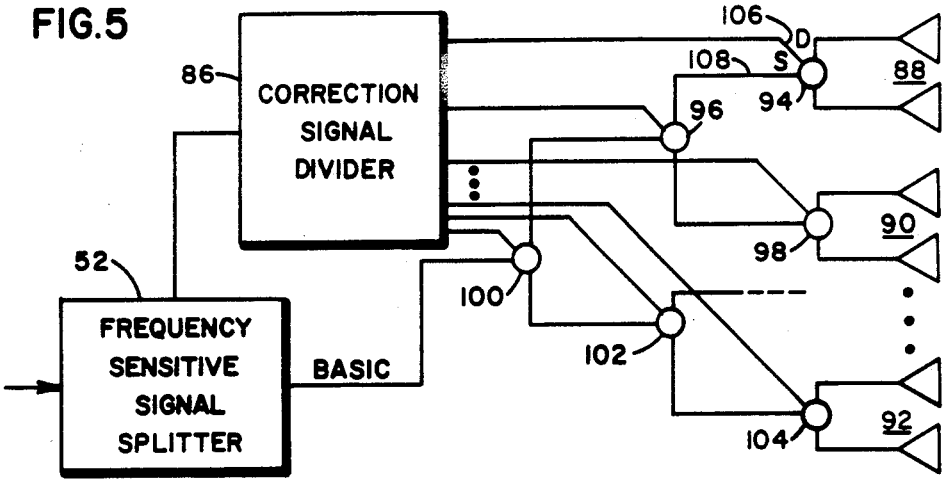
FIG. 5 is a diagram illustrating a corporate embodiment of the invention.

FIG. 5 is a diagram illustrating a corporate embodiment of the invention wherein the basic and correction signals are added in a parallel fashion instead of the series arrangement shown in FIG. 4. According to FIG. 5, the corporate arrangement includes a frequency sensitive signal splitter 52, a correction signal divider 86, and radiating element pairs 88, 90 and 92. Additional radiating element pairs may be used but are not illustrated in FIG. 5 in the interest of clarity of the figure.

The frequency sensitive signal splitter 52 is constructed similarly to the signal splitter of FIG. 4 and generally provides the basic and correction signals to the other divider circuits of the antenna system. The correction signal divider 86 in this embodiment is a multi-output divider which has outputs connected to the directional couplers 94, 96, 98, 100, 102 and 104. Each of these directional couplers has difference and sum terminations, as indicated by the difference connection 106 and the sum connection 108 of coupler 94.

The array of couplers are arranged in different levels to divide the basic and correction signals into a pattern for ultimate application to the antenna element pairs. In each case, the correction signals from the correction signal divider 86 are applied to the difference terminals of the directional couplers, and the basic signal is applied to sum terminals of the directional couplers in all levels of the array. The result of the combining of the correction and basic signals with the array shown in FIG. 5 produces a voltage distribution at the antenna element pairs which corresponds to the high frequency, low frequency, and basic distribution curves of FIG. 2.

Figure 6:
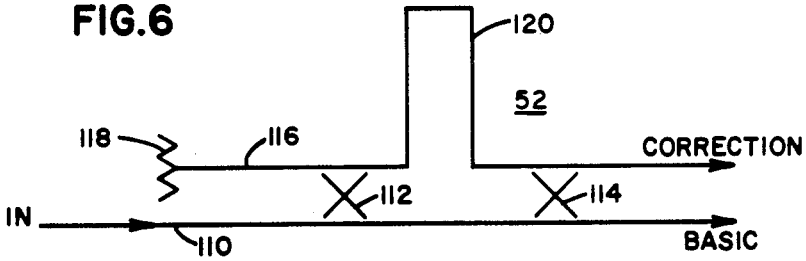
FIG. 6 is a schematic representation of a frequency sensitive signal splitter used by this invention.

FIG. 6 is a schematic representation of a common embodiment of the frequency sensitive signal splitter, or correction coupler, 52 constructed according to this invention. The signal splitter of FIG. 6 is well known in the prior art for coupling together various microwave devices and, in certain applications, is known as a diplexer. However, the outputs of the circuit of FIG. 6 are conventiently the desired outputs needed to function with the circuits of FIGS. 4 and 5 to provide the basic and correction signals needed to give the constant beamwidth characteristics of the antenna system. In general, the splitter 52 varies the magnitude and phase of the correction signal as the frequency changes.

According to FIG. 6, the splitter, or correction coupler, 52 includes an input path, circuit, or waveguide 110 which is coupled to another waveguide by the directional couplers 112 and 114, which are shown schematically according to normal nomenclature. The directional couplers 112 and 114 normally would be 3 dB directional couplers which couple one-half of the power from the input of the basic waveguide 110 of the correction circuit or path 116. A terminating impedance, or load, 118 is connected to one end of the correction path and a long line, or extension 120, is provided in the correction path between the directional couplers 112 and 114. The length of the long line 120 determines the characteristics of the correction signal and its variation with frequency. According to this invention, the length of the long line 120 should be an odd multiple of one-half the wave length of the center frequency of the antenna's bandwidth. In other words, if the antenna was designed to operate over a frequency range of 1200 to 1400 gigahertz, the long line 120 would be dimensioned to be an odd multiple of a half wave length at 1300 gigahertz. The number of the odd one-half wave lengths adjusts or controls the rate at which the correction signal changes.

There is a relationship between the magnitude of the correction signal provided by the circuit of FIG. 6 and the values of the directional couplers used in the combining circuits to couple the correction signal to the antenna elements. Determining the length of the line 120 must take into consideration the values of the directional couplers used in the combining circuits, although the methods for arriving at the coefficient values and the length of the long line 120 should be well known by those skilled in the art of feeding array antenna elements.

Figure 7:
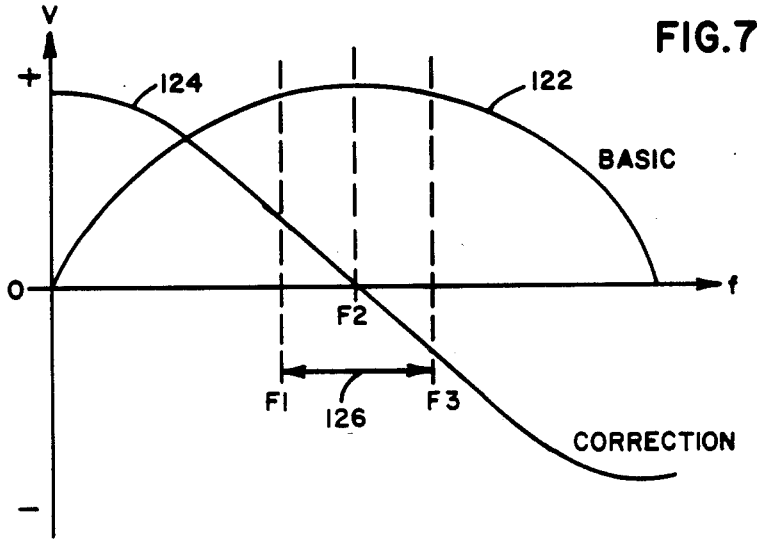
FIG. 7 is a graph illustrating the variation of signals provided by the splitter of FIG. 6.

FIG. 7 is a graph illustrating the variation of signals from the signal splitter 52 of FIG. 6. According to FIG. 7, the basic signal varies according to curve 122 and the correction signal varies according to curve 124. F2 represents the center frequency of the antenna's operation and the separation distance 126 between the frequencies F1 and F3 indicates the bandwidth or range over which the antenna is designed to operate.

At the center frequency of operation, the basic signal is maximum and the correction signal is at zero. Therefore, no correction is added to the voltage distribution across the antenna elements when the signal is at mid-frequency. When the frequency increases, the voltage of the basic signal decreases and the magnitude of the correction voltage increases with a phase relationship which places curve 124 into the negative side of the voltage axis. When the frequency decreases from the center frequency, the basic signal also decreases and the correction signal increases on the positive side of the voltage axis. In each case where the correction signal increases and the basic signal decreases, the complex adding of the two voltage signals by the couplers in the combining circuits provides the desired distribution across the antenna elements, with the adding of the voltages being also dependent upon the values of the couplers in the combining circuits. The splitter 52 provides sinusoidally varying basic and correction signals which are displaced a quarter cycle. That is, when one signal is at its maximum magnitude, the other signal is at zero magnitude.

There has been disclosed herein a unique system for compensating for wavelength changes when the frequency of operation is changed. The compensation circuitry produces a constant beamwidth pattern for the antenna when operating over a relatively wide range of frequencies. This is accomplished by using only one frequency sensitive circuit for all of the antenna elements of the system. It is emphasized that numerous changes may be made in the above described system without departing from the teachings of the invention. It is also intended that all of the matter contained in the foregoing detailed description, or shown in the accompanying drawings, shall be interpreted as illustrative rather than limiting.

I claim as my invention:

1. An array antenna system which exhibits a constant beamwidth in at least one plane while operating over a wide frequency range, said antenna comprising:

a plurality of spaced antenna elements;

first means for coupling the antenna elements to a basic signal circuit;

second means for coupling the antenna elements to a correction signal circuit; and splitting means for coupling a common signal circuit to the basic and correction signal circuits, with the value of the coupling between the common, the basic, and the correction signal circuits being dependent upon the frequency of the coupled signals.

2. The array antenna system of claim 1 wherein the splitting means varies, with frequency, the signals coupled to the correction signal circuit a sufficient amount to cause the signals coupled to each of the antenna elements from the basic and correction signal circuits to have the distribution needed to maintain the same beamwidth over the frequency range.

3. The array antenna system of claim 1 wherein the second coupling means provides predetermined frequency independent coupling values between the antenna elements and the correction signal circuit with said values causing the signals coupled to each of the antenna elements from the splitting means to have the distribution needed to maintain the same beamwidth over the frequency range.

4. The array antenna system of claim 1 wherein the splitting means provides a 90 degree shift between signals on the basic and correction signal circuits, with the basic and correction signals varying sinusoidally.

5. The array antenna system of claim 1 wherein the splitting means includes:

a basic signal transmission path;

a correction signal transmission path;

first and second directional couplers positioned to couple together said basic and correction signal transmission paths; and means for extending the length of the portion of the correction signal transmission path located between said first and second directional couplers.

6. The array antenna system of claim 5 wherein the extending means includes a transmission path equal to an odd multiple of one-half the wave length of the center frequency of the frequency range.

7. The array antenna system of claim 1 wherein the first coupling means includes a plurality of directional couplers serially positioned along the basic signal circuit, with each of said couplers being connected to a different antenna element in the plane of the constant beamwidth.

8. The array antenna system of claim 7 wherein the coupling values of the directional couplers are frequency independent and predetermined to provide the desired antenna beamwidth at the center frequency of the frequency range without any signal from the correction signal circuit.

9. The array antenna system of claim 1 wherein the second coupling means includes a plurality of directional couplers serially positioned along the correction signal circuit, with each of said couplers being coupled to a different antenna element through an associated directional coupler in the basic signal circuit.

10. An array antenna system which exhibits a constant beamwidth in at least one plane while operating over a wide frequency range, said antenna comprising:

a plurality of spaced antenna elements grouped into pairs of antenna elements;

first means for coupling each of the antenna element pairs to a basic signal circuit;

second means for coupling each of the antenna element pairs to a correction signal circuit; and splitting means for combining the basic and correction signal circuits into a common signal circuit, with the value of the coupling between the common, the basic, and the correction signal circuits being dependent upon the frequency of the coupled signals, said first and second coupling means comprising directional couplers having sum and difference connections, the first and second coupling means being arranged in a corporate structure with the basic signal circuit connected to the sum connections of the directional couplers, with each coupler connected to at least a pair of antenna elements, and with the correction signal circuit connected to the difference connections of said directional couplers.

11. An array antenna system which exhibits a constant beamwidth in at least one plane while operating over a wide frequency range, said antenna comprising:

a plurality of spaced antenna elements;

an array of directional couplers for coupling the antenna elements to a basic signal circuit and to a correction signal circuit, with the values of the couplers being frequency independent and predetermined to provide the desired antenna beamwidth at the center frequency of the frequency range without the presence of any correction signal; and a frequency sensitive correction coupler for coupling the basic and correction signal circuits to a common circuit, said correction coupler providing signals on the basic and correction signal circuits that vary sinusoidally with frequency and which are displaced one quarter cycle on the frequency scale.

12. The array antenna system of claim 11 wherein the correction coupler includes:

a basic signal transmission path;

a correction signal transmission path;

first and second directional couplers positioned to couple together said basic and correction signal transmission paths; and means for extending the length of a portion of the correction signal transmission path located between said first and second directional couplers.

13. The array antenna system of claim 12 wherein the extending means includes a transmission path equal to an odd multiple of one-half wave lengths of the center frequency of the frequency range.

14. The array antenna system of claim 11 wherein the array of directional couplers includes:

a plurality of basic directional couplers serially positioned along the basic signal circuit, with each of said basic couplers being coupled to a different antenna element in the plane of the constant beamwidth; and a plurality of correction directional couplers serially positioned along the correction signal circuit, with each of said correction couplers being coupled to an antenna element through an associated coupler in the basic signal circuit.

15. The array antenna system of claim 11 wherein the array of directional couplers are arranged in a corporate structure with the basic signal circuit connected to the sum connections of the directional couplers, with each coupler connected to at least a pair of antenna elements, and with the correction signal circuit connected to the difference connections of said directional couplers.

* * * * *